US005618064A

United States Patent [19]

Main

[11] Patent Number: 5,618,064

[45] Date of Patent: Apr. 8, 1997

[54] PACKING SLIP AND SHIPPING LABEL COMBINATION

[75] Inventor: George W. Main, Essex Junction, Vt.

[73] Assignee: KoBel International, Milton, Vt.

[21] Appl. No.: 582,100

[22] Filed: Jan. 2, 1996

[51] Int. Cl.[6] ..... B42D 15/00

[52] U.S. Cl. ..... 283/80; 283/81; 283/79; 283/109

[58] Field of Search ..... 283/79, 80, 81, 283/107, 109

[56] References Cited

U.S. PATENT DOCUMENTS

| | | | |
|---|---|---|---|
| 5,421,778 | 6/1995 | Konramanis | 283/79 X |
| 5,439,721 | 8/1995 | Pedroli et al. | 283/109 X |
| 5,484,168 | 1/1996 | Chigot | 283/79 X |
| 5,514,860 | 5/1996 | Benson | 283/109 X |

*Primary Examiner*—William Fridie
*Attorney, Agent, or Firm*—Thomas N. Neiman

[57] ABSTRACT

The present invention is directed to a label structure which is a combination packing slip and shipping label for use on a package. The packing slip has a front side having an area onto which the destination of the package and a description of items to be contained in the package can be printed. The shipping label, which is preferably substantially transparent, has a top side and a bottom side. The bottom side preferably has an adhesive coating adhered thereto. The shipping label is removably attached to the back side of the packing slip until it is ready for use. In order to facilitate the removal of the shipping label from the back side of the packing slip, a layer having a substantially smooth surface is preferably adhered to the back side of the packing slip. In use, the destination of the package and the contents to be packed therein are preferably transcribed on the front side of the packing slip. Thereafter, the shipping label is removed from the back side of the packing slip, the packing slip is folded such that the destination is visible, and the folded packing slip is placed next to the bottom side of the shipping label. The shipping label, with the destination showing therethrough, is affixed to the package and secured thereto via the adhesive coating adhered to the shipping label.

19 Claims, 2 Drawing Sheets

PACKING SLIP AND SHIPPING LABEL COMBINATION

BACKGROUND OF THE INVENTION

The present invention is directed to a label. More particularly, the present invention is directed to a combination packing slip and shipping label.

Packing slips and shipping labels are well known in the art. A common way for a shipper of goods to forward its products to a buyer is via transport in a container or package, such as a corrugated cardboard box.

The shipper typically includes with the shipment a list of goods contained in the package. Where the list is attached to the outside of the package, the list is commonly referred to as a packing slip.

In order to attach the packing slip to the outside of the package, the packing slip is typically placed in a pouch or other type of envelope structure, referred to herein as a shipping label, and the shipping label is affixed to the package. The side of the shipping label which is affixed to the package either contains an adhesive which is exposed via a peel-off backing or a dry adhesive which must be moistened. There are disadvantages to both.

The peel-off backing inherently provides a waste product (the Peeled-off backing itself). The dry adhesive requires either access to a source of moisture, such as a wet sponge, or requires the shipper to moisten same with his or her tongue. The former may be inconvenient, while the latter is generally unpleasant and unacceptable in large scale shipping operations.

There are certain other disadvantages to the two-part packing list and shipping label. For example, because the packing list and shipping label are separate items, they must be ordered separately. Additionally, misplacing and or waste of at least a portion of either the packing lists of the shipping labels is common. Thus, ordering the same quantity of each does not insure one-to-one correspondence.

Accordingly, there is a need to provide a two-part packing list and shipping label system which overcomes the above deficiencies.

SUMMARY OF THE INVENTION

Particularly, it is the object of this invention to teach a packing slip and shipping label combination attachable to a package, said structure comprising a packing slip having a first side and a second side, the first side having a first and second printable area for providing a destination of the package and a description of the items to be contained in the package, respectively; a layer of material adhered to a portion of the second side of the packing slip; a substantially transparent shipping label having a first side and a second side, the first side of the shipping label having an adhesive coating adhered thereto and located substantially along the peripheral edges of the shipping label, the first side of the label being removably attachable to the second side of the packing label on said second side of the packing slip on said layer of material; wherein said shipping label is removable from said second side of said packing slip is foldable and locatable between said first side of said shipping label and said package, and said first side of said shipping label is attachable to said package via said adhesive coating located substantially along said peripheral edges of said shipping label.

BRIEF DESCRIPTION OF THE INVENTION

Further objects and features of this invention will become more apparent by reference to the following description taken in conjunction with the following figures, in which:

FIG. 1 illustrates the front side of the packing slip of the present invention; and FIG. 2 illustrates the back side of the packing slip of the present invention, with the shipping label removably attached thereto.

DESCRIPTION OF THE PREFERRED EMBODIMENTS

Figure 1:
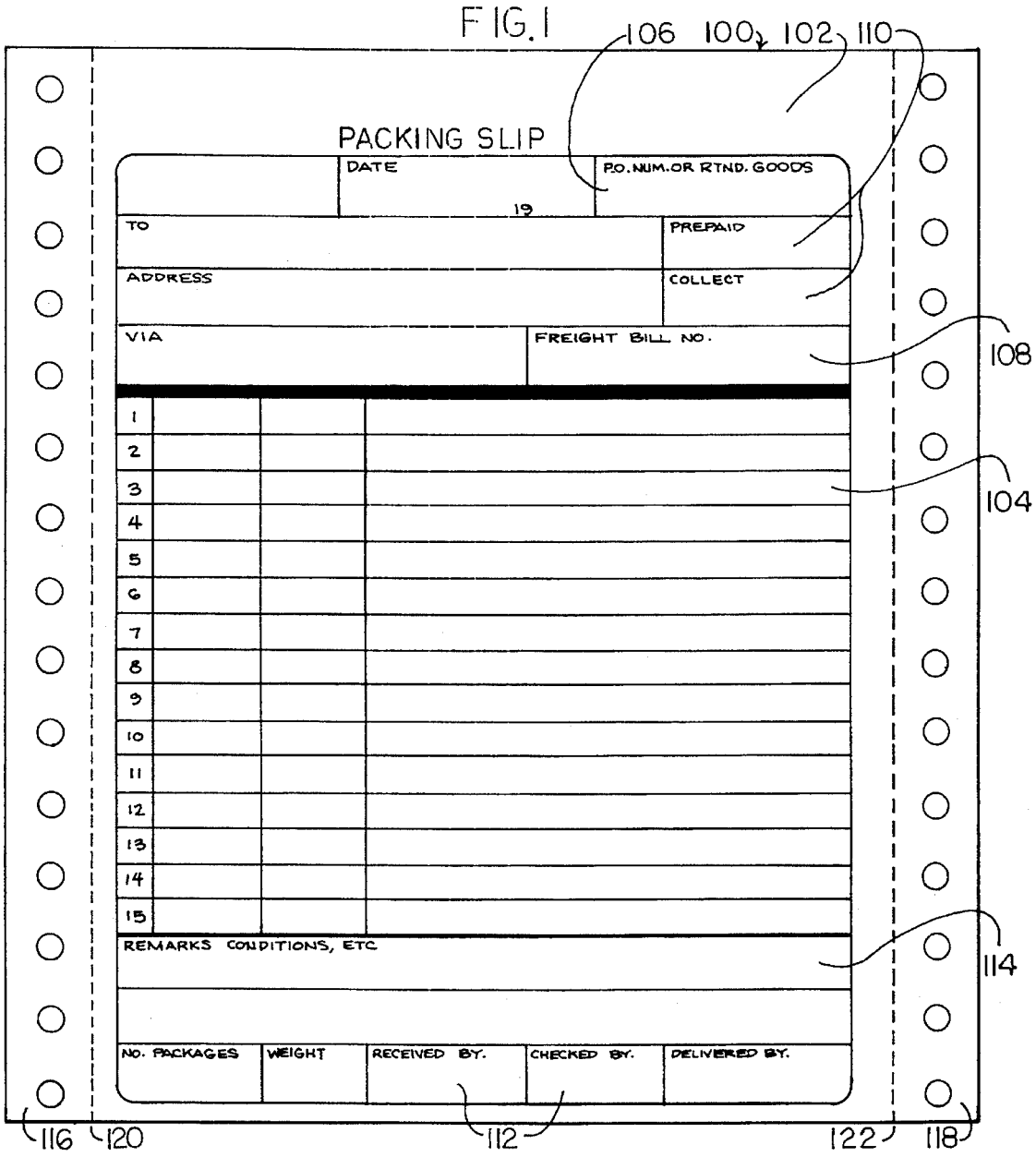

The present invention is a label structure attachable to a package and having a packing slip and shipping label. Turning now to FIG. 1, the front side of the packing slip of the present invention is shown.

Packing slip 100 has a front side which preferably contains printable area 102 to allow a user to transcribe the destination of the package and printable area 104 to allow the user to transcribe a description of items to be contained in the package.

Other printable areas can be included on the front side of packing slip 100, e.g., a purchase order number 106, freight airbill number 108, freight charges 110, certain shipper information 112, and shipper remarks 114.

In the preferred embodiment, the left and the right side of packing slip 100 comprises a plurality of holes located on strips 116 and 118, respectively. Strips 116 and 118 are preferable detachable via perforations 120 and 122, respectively.

The holes are preferably spaced substantially uniformly apart to accommodate the feeding of the label structure through a printing device (not shown). Thus, while only one packing slip is illustrated, it should be understood that a plurality of packing slips are preferably longitudinally attached to each other to permit the form feeding of same through a printing device (not shown).

Figure 2:
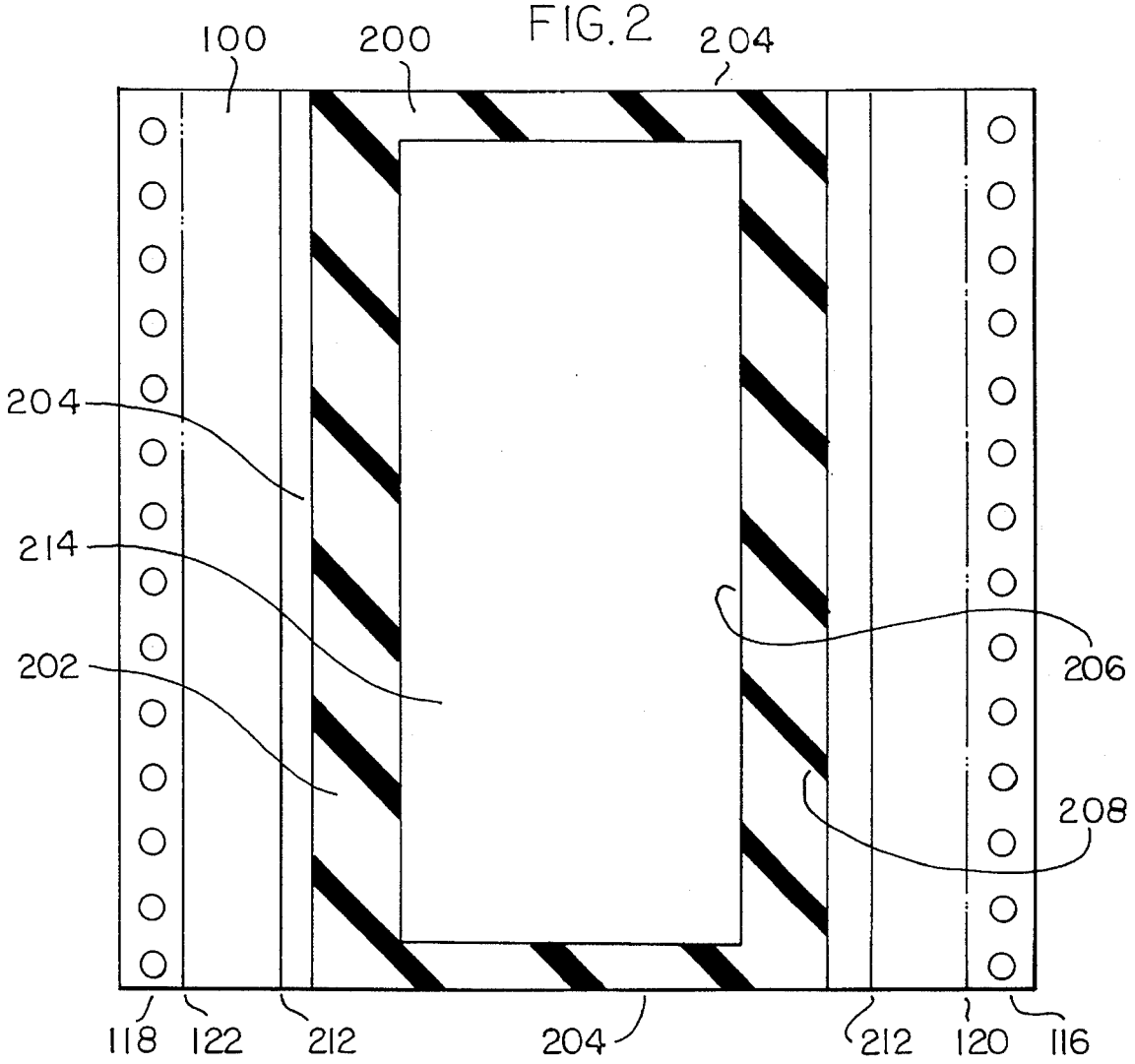

Turning now to FIG. 2, the back side of packing slip 100 of the present invention is shown. In the preferred embodiment, shipping label 200 is removably attached to the back side of packing slip 100. In this way, the user will have instant access thereto and the opportunity to misplace same is greatly reduced.

Shipping label 200 has a top side and a bottom side, with the bottom side preferably having adhesive 202 adhered thereto. Adhesive 202 is preferably located substantially along the peripheral edges of the shipping label, as indicated by the shipping label's outer edge 204 and inner edge 206.

Shipping label 200 preferably comprising substantially opaque markings 208 located along the peripheral edges thereof. Markings 208 help to indicate the approximate width of the peripheral edges of the shipping label where adhesive 206 is located. Additionally, markings 208 help to focus the user's attention thereat once the shipping label is attached to the package.

In order to facilitate the removal of shipping label 200 from the back side of packing slip 100, layer 210 having a substantially smooth surface is preferably adhered to the back side of the packing slip. Layer 210 is preferably adhered to portion 212 of the packing slip, such that the shipping label is removably attached thereover.

In the preferred embodiment, layer 210 comprises a coating of silicon or wax. Alternatively, other materials which facilitate the removal of the shipping label from the back side of the packing slip may be employed.

In use, and with reference to FIGS. 1 and 2, the destination of the package, the contents to be packed therein, and the other information to be supplied by the shipper are preferably transcribed on the front side of packing slip 100. This process can be either manual or via printing device (not shown). Once the printing has been transcribed thereon, strips 116 and 118 are preferably separated therefrom and appropriately discarded.

Thereafter, shipping label 200 is removed from the back side of packing slip 100, the packing slip is preferably folded such that the destination is visible, and the folded packing slip is placed next to the bottom side of the shipping label, preferably in center portion 214.

The shipping label, with the destination information preferably showing therethrough, is affixed to the package and secured thereto via the adhesive coating adhered along the peripheral edges of the shipping label.

In the preferred embodiment, the packing slip is folded in half or in thirds to fit under the shipping label. Any other number of folds will be obvious to those in the art.

Additionally, in the preferred embodiment, the surface area of the bottom side of the shipping label will accommodate the folded packing slip without same overlapping any portion of the adhesive coating located along the peripheral edges of the shipping label. The packing slip can overlap the area of adhesive coating if it has been treated with silicone.

In the preferred embodiment, the paper used for packing slip 100 is a paper coated on one side with clay, and is treated as follows to allow layer 210 to be adhered thereon. The material used for shipping label 200 is preferably plastic film. An area of the coated side of the paper is layered with a coating of silicone, and then a hot melt of adhesive is applied to the layer of silicone in a predetermined pattern. After the label and paper have been treated, the materials are laminated together by means of pressure and the adhesive is transferred to the plastic film to create the pressure sensitive label which will allow affixing of the combination packing slip and label to the shipping crate.

While I have described my invention in connection with specific embodiments thereof, it is clearly to be understood that this is done only by way of example and not as a limitation to the scope of our invention as set forth in the objects thereof and in the appended claims.

I claim:

1. A packing slip and shipping label combination attachable to a package, said structure comprising:

a packing slip having a first side and a second side, the first side having a first and second printable area for providing a destination of the package and a description of the items to be contained in the package, respectively;

a layer of material adhered to a portion of the second side of the packing slip;

a substantially transparent shipping label having a first side and a second side, the first side of the shipping label having an adhesive coating adhered thereto, the first side of said shipping label being removably attachable to the second side of the packing slip on said layer of material;

wherein said shipping label is removable from said second side of said packing slip, said packing slip is foldable and locatable between said first side of said shipping label and said package, and said first side of said shipping label is attachable to said package via said adhesive coating.

2. A packing slip and shipping label combination, according to claim 1, wherein:

said layer of material is silicone.

3. A packing slip and shipping label combination, according to claim 1, wherein:

said packing slip further comprising a first and second plurality of voids spaced substantially uniformly apart and located along a first and second peripheral end, respectively of said packing slip, the voids to accommodate the feeding of said label structure through a printing device.

4. A packing slip and shipping label combination, according to claim 3, wherein:

said packing slip further comprising a first and second set of perforations located substantially near the first and the second plurality of voids, respectively the first and the second plurality of voids being detachable from said packing slip via the perforations.

5. A packing slip and shipping label combination, according to claim 1, wherein:

said packing slip having a dimensional height PH;

said shipping label having a dimensional height SH, exclusive of said adhesive coating; and PH is equal to SH.

6. A packing slip and shipping label combination, according to claim 1, wherein:

said packing slip having a dimensional height PH;

said shipping label having a dimensional height SH, exclusive of said adhesive coating; and PH is equal to SH.

7. A packing slip and shipping label combination, according to claim 1, wherein:

said packing slip having a dimensional width PW;

said shipping label having a dimensional width SW, exclusive of the adhesive coating; and PW is equal to or greater than SW.

8. A packing slip and shipping label combination, according to claim 1, wherein:

said shipping label further comprising substantially opaque markings located thereon, said markings to indicate the approximate width of the peripheral edges of said shipping label.

9. A packing slip and shipping label combination, according to claim 8, wherein:

said substantially opaque markings are located on said first side of said shipping label.

10. A packing slip and shipping label combination attachable to a package, said structure comprising:

a packing slip having a front side and a back side, the front side of said packing slip having a first and second printable area for providing a destination of said package and a description of the items to be contained in the package, respectively;

a substantially transparent shipping label having a top side and a bottom side, the bottom side of said shipping label having a adhesive coating adhered thereto, the bottom side of said shipping label being removably attachable to the back side of said packing slip;

wherein said shipping label is removable from the back side of the packing slip, the packing slip is foldable and locatable between the bottom side of the shipping label and the package, and the bottom side of the shipping label is attachable to the package via the adhesive coating.

11. A packing slip and shipping label combination, according to claim 10, wherein:

a layer having a substantially smooth surface adhered to a portion of said back side of said packing slip, wherein said back side of said shipping label is removably attachable to the layer's smooth surface.

12. A packing slip and shipping label combination, according to claim 10, wherein:

a layer affixed to a portion of said back side of said packing slip, the layer located between said bottom side of said shipping label and said back side of said packing slip, the layer to facilitate the removal of said shipping label from said back side of said packing slip.

13. A packing slip and shipping label combination, according to claim 10, wherein:

said packing slip further comprising a first and a second plurality of voids spaced substantially uniformly apart and located along a first and second peripheral end, respectively, of said packing slip, the voids to accommodate the feeding of said label structure through a printing device.

14. A packing slip and shipping label combination, according to claim 13, wherein:

said packing slip further comprising a first and second set of perforations located substantially near the first and second plurality of voids, respectively, the first and second plurality of voids being detachable from said packing slip via the perforations.

15. A packing slip and shipping label combination, according to claim 10, wherein:

said packing slip having a dimensional height PH;

said shipping label having a dimensional height SH, exclusive of the adhesive coating; and PH is equal to SH.

16. A packing slip and shipping label combination, according to claim 10, wherein:

said packing slip having a dimensional height PH;

said shipping label having a dimensional height SH, exclusive of the adhesive coating; and PH is equal SH.

17. A packing slip and shipping label combination, according to claim 10, wherein:

said packing slip having a dimensional width PW;

said shipping label having a dimensional width SW, exclusive of the adhesive coating; and PW is equal to or greater than SW.

18. A packing slip and shipping label combination, according to claim 10, wherein:

said shipping label further comprising substantially opaque markings located thereon, said markings to indicate the approximate width of the peripheral edges of said shipping label.

19. A packing slip and shipping label combination, according to claim 10, wherein:

said substantially opaque markings are located on the bottom side of said shipping label.

* * * * *